US005512879A

United States Patent [19]

Stokes

[11] Patent Number: 5,512,879

[45] Date of Patent: Apr. 30, 1996

[54] APPARATUS TO PREVENT INFANT KIDNAPPINGS AND MIXUPS

[76] Inventor: John H. Stokes, 7336 York La., Lincoln, Nebr. 68505

[21] Appl. No.: 279,975

[22] Filed: Jul. 25, 1994

[51] Int. Cl.[6] ..... G08B 23/00

[52] U.S. Cl. ..... 340/573; 340/539; 340/572; 359/155; 455/100

[58] Field of Search ..... 340/573, 572, 340/574, 506, 505, 311.1, 825.08, 825.34, 825.44, 825.49, 539; 343/718, 878; 455/100; 128/903; 359/154, 155

[56] References Cited

U.S. PATENT DOCUMENTS 3,478,344 11/1969 Schwitzgebel et al. ..... 340/539 X
4,673,923 6/1987 Boscoe et al. ..... 340/572
4,952,928 8/1990 Carroll et al. ..... 340/825.54
5,032,823 7/1991 Bower et al. ..... 340/573 X
5,062,151 10/1991 Shipley ..... 340/825.49 X
5,218,344 6/1993 Ricketts ..... 340/573

*Primary Examiner*—Thomas Mullen

[57] ABSTRACT

A miniature electronic security tag is affixed to the ankle of a newborn infant. The tag contains an RF transmitter and digital encoding circuit. On a periodic basis, the tag transmits a unique encoded identity signal to receivers strategically placed within the hospital. The tag is attached to the infant with a security element having a plurality of conductors which form a plurality of complete electrical circuits while the tag is in place. Attempts to remove the tag by cutting or stretching the security element are detected by the encoder circuit, causing a change in the digital code which is transmitted. Receivers are interconnected to a central monitoring computer which continuously determines the identity and location of each infant. In the event an unauthorized person attempts to leave the hospital with an infant, or if the tag is removed, an alarm is sounded.

13 Claims, 7 Drawing Sheets

APPARATUS TO PREVENT INFANT KIDNAPPINGS AND MIXUPS

BACKGROUND

1. Field of the Invention

The present invention relates to an infant security system for use in hospitals to prevent kidnappings and mixups of newborn infants.

2. Description of Prior Art

In recent years, there have been numerous well publicized infant kidnappings in hospital maternity wards. Even more prevalent are those cases where infants have been inadvertently switched at birth or shortly thereafter with another infant. In the case of kidnappings, the results have often been tragic with the newborn infant never being found. In the case of mixups, parents have left the hospital with the wrong infant only to find out months or even years later about the mistake.

Hospitals have responded to the problem by increasing their levels of security and by adding additional staff members . Restricted access to maternity wards is also commonplace as a means of increasing security. These measures have proven to be largely ineffective in preventing either kidnappings or mixups. In the case of kidnappings, the perpetrator is often knowledgeable of hospital procedures and language and passes themselves off as a staff member. The infant is then removed from the maternity ward without raising the suspicion of the hospital staff.

In the event of a mixup, there is little likelihood of discovery since the only identification system in use by most hospitals is a plastic band placed upon the infant's wrist. There is no prior art automated system or device known to the author which can uniquely match newborn infants to their rightful mothers by providing a pair of matching security tags having encoded transmission signals which must match one another, and; which can simultaneously monitor the continued presence of infants.

A requirement thus exists for a security system which can prevent infant kidnappings and mixups in hospital maternity wards. In order to fully appreciate the novel features of the present invention, it is first necessary to delineate at least some requirements which a typical hospital would have for an infant security system. First and foremost, the system must have the ability to solve the two problems which have produced the need for such a system. That is, the system must be able to continually monitor the presence of infants within the hospital and must simultaneously provide a means of uniquely identifying each infant. In order to useable in the hospital environment, the system must allow for free movement of infants without compromising their security. Additionally, the system must provide for various medical tests to be conducted which may require that the infant be wearing no metallic objects. The system must be highly resistant to tampering since kidnappers are often aware of hospital procedures and speech mannerisms. Finally, the system must immediately notify hospital staff in the event of an infant mixup or kidnapping attempt. Heretofore, only limited prior art has existed specifically for infant security systems although other types of security systems may be of limited use. U.S. Pat. No. 4,899,134 to Wheeless (1990) describes a magnetic strip which is imbedded in an umbilical cord clamp attached to the infant. The clamp thus becomes a passive tracking device which can be detected by receiving apparatus at exits to the hospital. However, if discovered by a person attempting to kidnap the infant, the Wheeless device can be removed, rendering it ineffective. It is even likely that an untrained person could seriously injure an infant while attempting to remove an umbilical cord clamp. The claim by Wheeless that an advantage is gained by making the device unobtrusive does not consider the deterrent effect of security devices which are plainly visible. Wheeless undermines his original premise of providing an undetectable security device by disclosing an embodiment comprised of a battery powered radio transmitter which could be attached to the end of the umbilical cord clamp. Given the present state of technology in the area of miniaturization, it is unlikely that such a device could be reduced to practice in such small size as to be capable of being imbedded within the umbilical cord clamp of a newborn infant. Finally, the Wheeless device fails to disclose a means to uniquely identify infants in order to prevent mixups in hospitals.

U.S. Pat. No. 4,853,692 to Wolk et. al. (1989) discloses a second security system which is designed for infants which employs a radio frequency transmitter enclosed in a rugged plastic housing and attached with a plastic strap having a single conductor imbedded within. No means is disclosed for removing the plastic strap although a switch inside the plastic enclosure can be accessed to deactivate the tamper protection afforded by the strap. No protection is offered if the strap is partially severed or stretched. Since the device is described several times as being housed in a rugged plastic enclosure, no thought has been given to the comfort of the infant or to making the device easy to remove. A receiver placed on the infant's cart detects removal of the infant and tag from the immediate vicinity thus limiting tha ability of staff to move the infant freely within the hospital. A secondary protection is afforded by the inclusion of a magnetized strip affixed to the transmitter module which is used in conjunction with another group of receiving devices located at exits to the hospital. As previously stated, this strip can be removed thus rendering this type of protection ineffective. Finally, no disclosure is made as to any ability of the system to prevent mixups of infants.

U.S. Pat. No. 5,014,040 to Weaver et al. (1991) teaches a personal locator transmitter for use in a nursing home environment wherein there is a radio frequency transmitter enclosed in a plastic case similar to that of a large wristwatch and which includes a plastic strap with imbedded conductor to detect tamper attempts. The strap contains a ratcheting mechanism which requires that the strap be severed to remove the transmitter. This method of attachment is adjustable in only one direction and requires a special key to be inserted for periodic removal if necessary. As with other prior art, the strap can be stretched somewhat without breaking the security element thus defeating the tamper protection mechanism. Weaver discloses a means of changing the power output of the transmitter, but such change is made by a variation in the manufacturing process and cannot take place automatically within the tag. Furthermore, no means is provided for deactivating the tag once the case is closed.

U.S. Pat. No. 4,851,815 to Enkelmann (1989) depicts a security device which contains an encoded RF transmitter used in conjunction with an electrically conductive security element to monitor objects or persons. The Enkelmann device emits an audible alarm when removed from a continuous RF field , or alternatively; emits the same alarm in the presence of a different RF field. In the event the security element is severed, the alarm is also made to sound. The security element consists of a coaxial cable whereby the inner conductor forms a complete circuit and the outer sheath or conductor forms the transmitter aerial. The aerial in Enkelmann is part of a tuned circuit which would be compromised in the event the length of the security element needed to be changed to accommodate people or objects of different size. There is no means disclosed by Enkelmann for removal or reattachment of the device. The device could also be defeated by stretching the security element in the process of removal. A group of internal switches must be set to produce the digital code thus causing the device to be unnecessarily large.

U.S. Pat. No. 4,952,913 to Pauley (1990) also teaches a device employing an RF transmitter used in conjunction with a conductive band to affix an active tag to personnel being monitored. Pauley further teaches the use of capacitive coupling techniques to insure that the band is in place about the wrist or ankle of a human being. An AC signal is imposed upon a conductor which is arranged in parallel with a second conductor. The signal from the first conductor is coupled by the proximity of human skin to the second conductor. The presence of this signal is then continuously monitored. The Pauley device must be fastened tightly enough to maintain this capacitive coupling. The band of the Pauley device must be also be completely severed in order to detect its removal. If it were possible to place a finger beneath the band of the Pauley and stretch it over the ankle or wrist, the capacitive coupling would remain in effect, the band would not have been severed and the system would have been defeated. Finally, the Pauley device discloses a requirement for coding switches to set the coded identity data transmitted by the tag; a coding method which is also present in other prior art.

U.S. Pat. No. 4,682,155 to Shirley (1987) discloses a security system for monitoring persons within a nursing home environment whereby the resident wears an electronic trigger module to sound an alarm when a door equipped with a receiver module is opened. The transmission range of the Shirley deice is purposely limited to a few feet thus making it unsuitable for continuous monitoring of a person or object which might be located some distance from the door. Furthermore, the Shirley device is attached with a strong, non removable band making it easy to defeat if the band is severed and the person or object is removed leaving the trigger device behind.

It is thus well known that an electronic method may be employed to monitor persons or objects using either active or passive security tags affixed by a band to the subject being monitored. It is also well known that such bands may contain a conductive security element which, if severed, will create an alarm condition. The present invention however overcomes limitations of all known prior art by providing an infant security system having a security tag which is easily removable yet which can detect the band being severed, stretched or removed; the band in acuality being a security element attachment apparatus. The present invention provides a security tag which is easily removable and is therefore contrary to the teachings of prior art. The problem of providing a removable security tag is unrecognized in prior art which typically employs the strongest types of non removable bands. Furthermore, the present invention employs a security element which can detect being stretched as well as being severed which is a feature not suggested by prior art. In addition, the present invention omits the element of coding switches in known prior art while maintaining the capability of transmitting a coded identity signal. Finally, the present invention solves the problem of providing a method of deactivating expendable security tags after use which is unrecognized in prior art disclosures.

At first glance, several prior art devices would appear to be useful in providing security to newborn infants; however they each suffer from major deficiencies. Prior art devices contain no provision for periodic removal if necessary or for deactivating if required for testing within the hospital environment. Capacitive coupling to human skin as a method of detecting removal may not be possible under all circumstances. For example, infants who lose weight shortly after birth would cause the Pauley device to become loose and erroneously cause an alarm. The Pauley device is also limited to use on a human being by teaching capacitive coupling as a means for determining the continuing proximity to human skin and is thus not suitable for protecting objects in addition to persons.

Prior art devices which may be adaptable for infant security do not consider those requirements which are unique to the hospital environment. Rather, the band which is used to attach virtually all such devices is usually made as difficult as possible to remove. No existing device known to the inventor currently can accommodate the changing size of an infant's arm or leg as a result of weight loss. No security device disclosed in prior art contains a security element which is easily removed yet which can detect being severed as well as being stretched. Known prior art devices can be defeated by removal or stretching the attachment band in such a way that the conductive security element is not broken. While there are known conductive security elements which cannot be stretched, these are specified to be comprised of such materials as steel cable as in the case of U.S. Pat. No. 4,962,369 to Close (1990), or mechanical jaws such as disclosed in U.S. Pat. No. 4,573,042 to Boyd (1986). No known prior art security system is comprised of a tag which lends itself to attachment on the ankle or wrist of a newborn infant. Furthermore, none of the known existing technologies lend themselves to easy removal or adjustment of the attachment band nor do they provide a means for continuously monitoring both the unique identity and location of a person or article.

The present invention thus meets a long felt but previously unsolved need for a removable and adjustable security tag which can prevent infant kidnappings and mixups while overcoming the deficiencies of prior art as will be clearly seen from disclosure of the claims herein.

OBJECTS OF THE INVENTION

It is a primary object of the present invention to provide a security system for protecting newborn infants in hospital maternity wards from kidnappings and mixups with other infants by electronically monitoring the infants presence and identity.

Another object is to provide an infant security system which monitors the location of each infant and allows for their free movement within the hospital yet which sounds an alarm in the event the infant is removed from the area of continuous monitoring, taken through a doorway equipped with a receiver or if the electronic security tag is tampered with in any way.

Another object is to provide an infant security system for immediately and simultaneously notifying both nursing and security staff in hospitals in the event of an infant kidnapping attempt or mixup by causing the system to sound an audible alarm for nearby staff and by transmittng an alarm page to paging type receivers worn by security personnel.

Another object is to provide an infant security system which is capable of identifying the door through which an infant has been taken if the taking was unauthorized.

Another object is to provide an infant security system which is comprised of autonomous yet interactive elements such that the failure of any element or elements of the system will be reported by other elements of the system which are still functioning.

Another object is to provide an expendable electronic security tag which is capable of uniquely identifying the infant to which it is attached by producing an encoded RF signal on a periodic basis such that the encoded signal can be used to both identify and locate the infant.

Another object is to provide a power conservation circuit within the security tag which causes the tag to be operable only on a periodic basis.

Another object is to overcome the limitations of prior art security systems employing security tags which may be defeated simply by removing the tag from the person or article being protected.

Another object is to provide a security element attachment apparatus for attaching the security tag to the infant which, in a first preferred embodiment; is comprised of a plurality of conductors such that any movement between the two ends of the apparatus such as would be caused by attempts to stretch or remove the apparatus would be detectable by a tamper circuit within the tag.

Another object is to provide a security element attachment apparatus for attaching the security tag which, in a second preferred embodiment, would contain an elastic portion through which are passed a plurality of conductors; one or more of which would break if the apparatus were stretched in an unauthorized removal attempt.

Another object is to provide a security tag which is constructed of a strong flexible printed circuit board material such as Kapton(tm) manufactured by DuPont Incorporated which provides a substrate for attaching the components of the encoding and transmitting circuits of the security tag and which also functions as the attachment apparatus and tamper prevention mechanism as well.

Another object is to provide an security element attachment apparatus for the security tag which allows it to be easily removable for testing and for free movement of the infant within the hospital yet which can report any unauthorized attempts at removal by severing or stretching the apparatus.

Another object is to provide a low power security tag and transmitter which can be powered by an internal direct current power source, have up to a six month shelf life and which can be activated immediately,prior to use.

Another object is to provide a security tag containing an RF transmitter and omni directional transmitting antenna such that the tag may be picked up by receivers regardless of the tag orientation.

Another object is to provide a security tag which is capable of self deactivation subsequent to the infant being checked out of the hospital.

Another object is to provide a security tag which is no larger than a typical ladies wristwatch in order to make it comfortable for the infant to wear.

Another object of the invention is to provide a security tag which will not bruise newborn infants by encapsulating the tag in a soft flexible plastic material such as synthetic rubber which will conform to the ankle or wrist of the infant.

Another object is to provide a method of encoding and transmitting identification data from the security tag in such a manner that multiple tags can be made to transmit on a periodic basis with minimal likelihood of interference between one another.

Another object is to provide a security tag which can be electronically imprinted with a unique identifying code as a part of the manufacturing process wherein such code is permanently stored in a non volatile memory thus negating the requirement of having to set coding switches within the security tag.

Another object is to provide a security tag with a security element attachment apparatus which may be easily adjusted as necessary due to weight loss or gain by the infant and for use on infants of widely differing sizes such as premature infants.

Another object is to provide a security tag with a security element attachment apparatus which may be easily adjusted as necessary for use on objects of differing sizes.

Still another object is to provide a central monitor computer element of the infant security system which is protected against unauthorized use or operation and which requires passwords for operation by hospital staff.

Yet another object is to provide a remote security console which provides a real time display of the status and location of each infant within the hospital.

SUMMARY OF THE INVENTION

In accordance with one aspect of the invention, there is provided an electronic security tag which may be affixed to the ankle or wrist of a newborn infant. The tag generates periodic bursts of coded RF energy which are picked up by receivers strategically located within the hospital. An identical security tag may be worn by the infants mother. In the event one infant is inadvertently switched with another, coded signals from the infant's and mother's tags will not match thus causing the infant security system to notify the hospital of the mistake.

In accordance with another aspect of the invention, the same security tag is attached to the ankle or wrist of a newborn infant with a conductive security element comprising a plurality of both conductors and crosswise bridging contacts. In the event the security element is severed, one or more circuits will be broken thus changing the digital code which is transmitted and causing an alarm to be sounded. In the event the security element is stretched, one or more conductors in the conductive security element will be broken or will change place with respect to a plurality of bridging contacts thus causing the alarm to be sounded just as if the security element had been severed.

A novel feature of the tag allows it to be removed if necessary for any required medical testing of the newborn infant. Prior to such removal, a central monitor computer operably connected to receiving devices located throughout the hospital is notified that the tag is to be removed thus preventing the sounding of an alarm. Since the conductive security element contains a plurality of conductors, adjustments may be made as the infant gains or looses weight. Such a band could thus be useful with very tiny premature infants as well as for normal infants whose whose stay in the hospital is limited to only a few days. An adhesive substance on the mating surfaces of the band insures that the proper electrical circuits are maintained while at the same time providing for easy removal and later reattachment if desired.

Another novel feature of the band is an electrically conductive area consisting of two conductors arranged in an interlocking matrix which are used to keep the security tag in an inactive state. Subsequent to manufacturing and testing, a flexible electrically conductive removable material is affixed to this area of the band and covering the two conductor matrix. The completion of this circuit prevents the security tag from becoming fully active. When the security tag is to be attached to the infant, the conductive material is removed and the security tag begins transmitting its unique identifying and locating code.

Another feature of the present invention is that the security tag and transmitter assembly is housed in a soft, flexible plastic which will conform to the curvature of the infant's leg or wrist thus preventing bruising and providing a measure of comfort not possible with larger prior art security tags which are typically encased in hard plastic or even metal.

Another novel feature of the invention provides a means for the security tag to self deactivate within 2 to 4 hours after the infant has checked out of the hospital. In this manner, the security tags may be carried home by the infant's family with no fear on the part of the hospital that the security tag could be reused. When the band comprising the conductive element is severed or stretched or simply removed from the infant, a power monitoring circuit within the security tag increases the RF power output by a factor of 5. At the same time, the interval between radio frequency transmissions is reduced to ⅕ the normal period which causes the security tag to consume 5 times the normal amount of current. Additionally, an energy absorbing circuit begins to drain the internal direct current power source. The normal 30 day operating lifetime of the security tag is thus reduced to approximately 2–4 hours after removal from the infant at which time the internal direct current power source is exhausted and the security tag ceases to function.

A further novel feature of the invention is the method of inserting a unique identification code into each security tag. An electronic circuit containing an electrically erasable programmable read only memory is incorporated into the security tag. A programming apparatus stores a unique identification code into each security tag as a part of the manufacturing process. Once programmed, the identification code within the security tag cannot be changed or erased. There is no requirement to set coding switches in order to insure a unique identity code.

DETAILED DESCRIPTION OF THE PREFERRED EMBODIMENTS

The present invention is best understood by reference to drawings wherein like numerals are used to represent like parts throughout.

Figure 1:
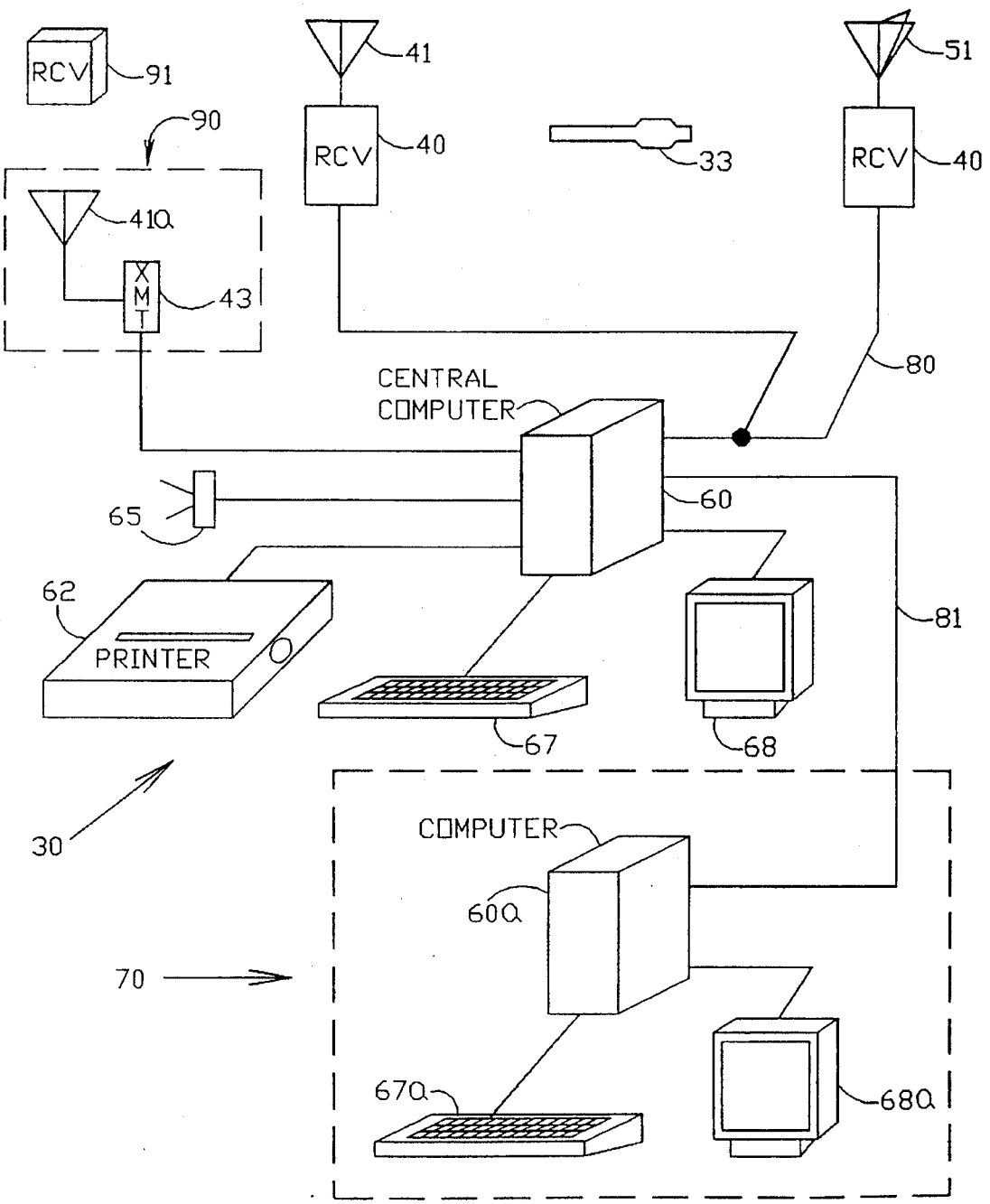
FIG. 1 depicts a first embodiment of the infant security system.

Referring first to FIG. 1, there is shown a drawing of an infant security system 30 comprising an electronic security tag 33, a receiver 40, a central monitor computer 60 to which is attached a CRT display 68 and a keyboard 67, a local audible alarm 65, a directional antenna 41, an omni directional antenna 51, a paging transmitter 90 (which includes transmitter 43 and directional antenna 41*a*), a remote security console 70 (which includes computer 60*a*, and keyboard 67*a*), a printer 62, a first RS485 communications line 80, a second RS485 communications line 81, and a paging receiver 91. System 30 also includes a plurality of receivers 40 which may be concentrated at locations such as nurseries within the hospital or which may be scattered throughout the entire maternity floor as well as at exits to the hospital. Although there is shown only one tag 33, there will be a plurality of tags in use since numerous infants are often present in hospital maternity wards. Receivers 40 are attached to computer 60 by means of communications line 80. Each tag 33 periodically activates an internal radio frequency transmitter 21 which sends a unique identifying code to be picked up by receiver 40 and antenna 41 or 51. When system 30 is installed, each receiver 40 is attached to a directional antenna 41 or omni directional antenna 51 dependent upon the desired location of receiver 40 within the hospital. When receiver 40 is configured for continuous monitoring of tags 30 and to provide an inner protection loop, omni directional antenna 41 is connected to receiver 40 such that tags 33 may be received over a wide area of approximately 60 feet in diameter. In the event of any change in the number or identity of tags 33 being received, receiver 40 alerts computer 60 to any change in the number or coding of tags 33 being received. Computer 60 compares the identities of tags 33 being received by receiver 40 with a list contained in its memory. In the event one or more transmissions from any one tag 33 are missed by receiver 40, this change in status is reported by receiver 40 to computer 60 by a data transmission over communications line 80. Computer 60 then sounds a local alarm 65 to alert hospital staff that the transmission from a particular tag 33 may have ceased. If the problem is not resolved within a period of time which is programmed into computer 60, a paging alarm is sent through paging transmitter 90 to paging receivers 91 carried by security personnel. The actual number of allowable missed transmissions from tag 33 is also a programmable value in computer 60 in order to accommodate the likelihood that there may be interference between multiple tags 33 when large numbers are present in a small area.

A second ring of protection is formed by receivers 40 located at exits to the maternity floor or at exits to the hospital. Exit receivers 40 are equipped with directional antennas 41 which are designed to be mounted on the ceiling above the exit with the direction of reception being downward. The range of directional antenna 41 is designed to be approximately 12 feet. The high degree of directionality of directional antenna 41 prevents exit receiver 40 from accidentally picking up transmissions from tags 33 which are outside of the 12 foot maximum range and which may be elsewhere on the maternity floor. In the event an attempt is made to carry an infant through a doorway or elevator equipped with exit receiver 40 and directional antenna 41, receiver 40 reports the presence of tag 33 to computer 60.

Local alarm 65 is then made to sound by computer 60 which at the same time and initiates a security page which is transmitted by paging transmitter 90 and picked up by a plurality of paging receivers 91 carried by security personnel.

There are thus two separate and distinct types of protection provided by a plurality of inner protection loop receivers 40 and omni directional antennas 51 which are continually receiving transmissions from tags 33 and a second ring of protection which is provided by a plurality of exit receivers 40 and directional antennas 41 which will receive transmissions from tags 33 only when the distance between tags 33 and directional antennas 41 is approximately 12 feet or less.

Computer 60 is operably connected to local alarm 65, paging transmitter 90, communications loop 80 and remote security console computer 70. Security console 70 is a duplicate of computer 60 except that it receives its data regarding tag 33 transmissions from computer 60 rather than from receivers 40. In this manner, a failure of communications between computer 60 and any single receiver 40 or any group of receivers 40 is noted by computer 60. Likewise, the failure of any communications between computer 60 and security console 70 is noted by the remaining functional one of the pair. In this fashion, a failure of any element of system 30 is reported by other autonomous elements making it very difficult to tamper with any single element without causing alarm 65 to sound. Printer 62 is also attached to computer 60 for the purpose of printing summary activity reports in the event that the coming and going of a particular infant or infants needs to be investigated. A system of security codes and passwords must be entered into keyboard 67 for operation of computer 60 in order to prevent unauthorized deactivation of a particular infant's identity code. Likewise, the same system of passwords and security codes prevents the unauthorized use of computer 60 for any unauthorized purpose. CRT display 68, which is operably connected to computer 60 provides hospital staff with a real time display of the status of each infant being monitored by system 30.

Figure 2:
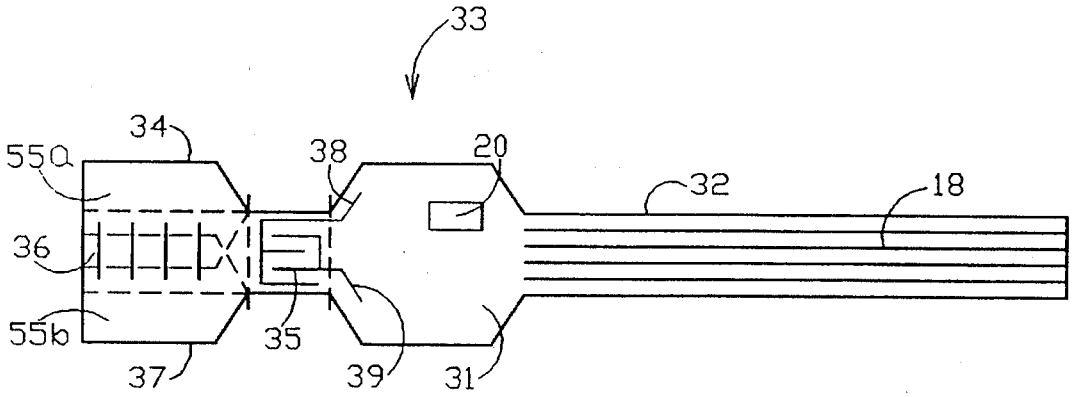
FIG. 2 shows a preferred embodiment of the security tag.
Figure 3A:
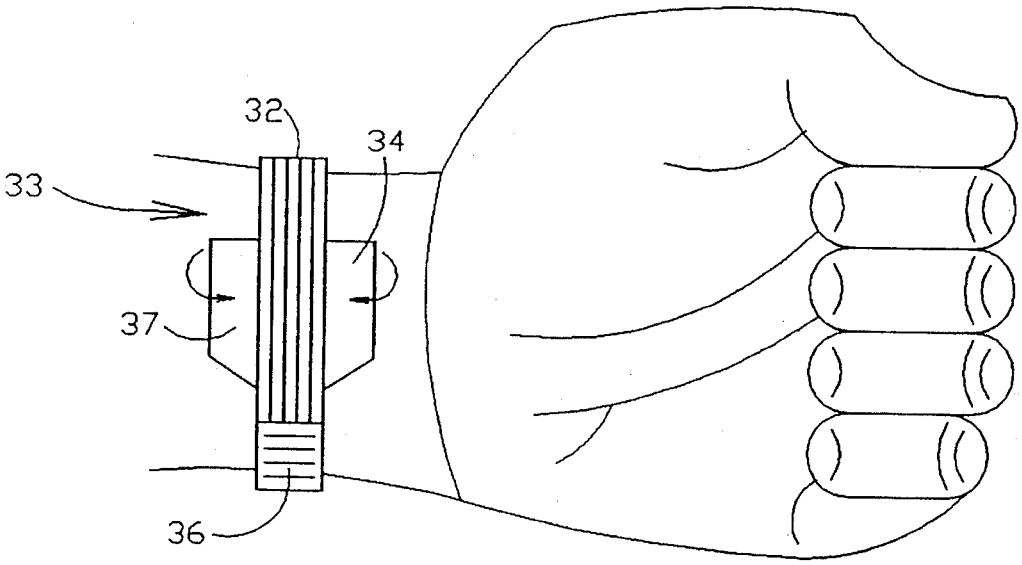
FIGS. 3*a* and 3*b* show the method of attaching the ends of the security tag to one another.
Figure 3B:
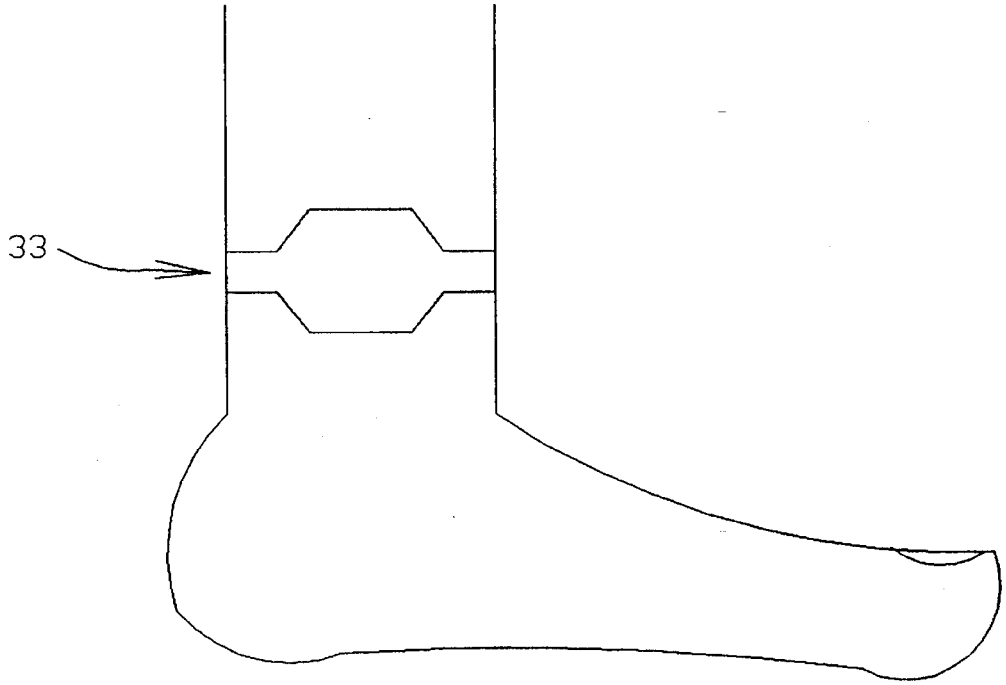

Referring now to FIG. 2, there is shown a preferred embodiment of tag 33 which is comprised of a circuit component area 31, an area in which there is a plurality of conductors comprising a conductive security element 32, two adhesive areas 34 and 37 to which are affixed an adhesive material 55*a* and 55*b* and a power activation circuit area 35 comprised of a reset single conductor 38 and a grounded single conductor 39 arranged in an interlocking matrix and a final area comprising a plurality of crosswise bridging contacts 36 which serve to complete a plurality of circuits in security element 32. Security element 32 area is superimposed upon bridging contacts 36 area when the band is affixed to the ankle (or wrist) of a newborn infant as is shown by FIGS. 3*a* and 3*b*. Security element 32 includes a plurality of conductors 18 which are imprinted upon the top side of the band. Bridging contacts 36 are imprinted upon the back of the band. In use, the band is wrapped around the ankle or wrist of a newborn infant. Certain of the plurality of conductors which form security element 32 and certain bridging contacts 36 then come into contact with one another in such a fashion that a plurality of completed circuits are formed; the exact number being dependent upon the diameter of the newborn infant's wrist or ankle. This plurality of completed circuits form a digital code which is read by encoder circuit 20 of tag 33 prior to initiating a periodic transmission by RF transmitter 21. The code generated by encoder 20 includes a plurality of bits permanently stored within a non volatile memory 19 portion of encoder 20 which are combined with a plurality of bits generated by the plurality of completed circuits formed by the joining of the plurality of conductors in security element 32 with the plurality of bridging contacts 36. Subsequent to wrapping the band ends around the infant's ankle or wrist and placing the bridging contacts 36 against security element 32, an adhesive area 34 followed by an adhesive area 37 are folded over one another in such a fashion as to cause the plurality of conductors on security element 32 to remain in contact with one or more bridging contacts 36.

Referring now to FIGS. 1, 2, and 3; in the event tag 33 needs to be removed for any authorized purpose, computer 60 is notified by staff of the impending removal through entry of appropriate passwords and codes into keyboard 67. Adhesive covered areas 34 and 37 of tag 33 may then be peeled back by a hospital staff member allowing the plurality of conductors on security element 32 to break their contacts with bridging contacts 36. Although this breaking of the plurality of circuits formed by the plurality of conductors on security element 32 with bridging contacts 36 causes a subsequent change in the digital code which is generated by encoding device 20 and transmitted by RF transmitter 21 of tag 33, local alarm 65 is not sounded by computer 60 since the removal of tag 33 was authorized. If however an attempt is made to remove tag 33 without the appropriate entries being made by hospital staff through keyboard 62, a different sequence of events will occur. Any movement of the plurality of conductors imprinted upon security element 32 with respect to the plurality of bridging contacts 36 such as would be caused by severing or stretching the band or by parting the ends of the band subsequent to their being joined together to form a plurality of completed circuits will cause a change in the digital code which is read by encoder circuit 20. At the time of the next periodic transmission period, this code is output by encoder circuit 20 to RF transmitter 21. The changed code is picked up by antennas 41 or 51 connected to receiver 40. The change in the code is noted by receiver 40 and is further reported to computer 60 by a data transmission on communications line 80. Computer 60 then sounds local alarm 65 and initiates the transmission of a page by paging transmitter 90 which is picked up by a plurality of paging receivers 91. Simultaneously, remote security console 70 is notified of the alarm condition by a data transmission on communications line 81. Paging receivers 91 Carried by security personnel display the unique identity code of the infant to which tag 33 had been attached along with the location of receiver 40 which picked up the alarm transmission.

In the event an unauthorized person attempts to remove an infant from the hospital with tag 33 still attached, the infant and tag 33 will eventually reach the second ring of protection comprised of a plurality of receivers 40 having directional antennas 41 and located at exits to the maternity floor or at main exits to the hospital. The interval of encoded transmissions by tag 33 is set to be approximately 5 seconds so that a person could not reasonably be expected to traverse the protective field of reception formed by antenna 41 and receiver 40 without at least one transmission having occurred. In the event any exit receivers 40 receive any transmissions from tags 33, the newly received identification code is reported to computer 60 which initiates the same alarm sequence as though tag 33 had been removed by an unauthorized person as previously described.

Figure 4:
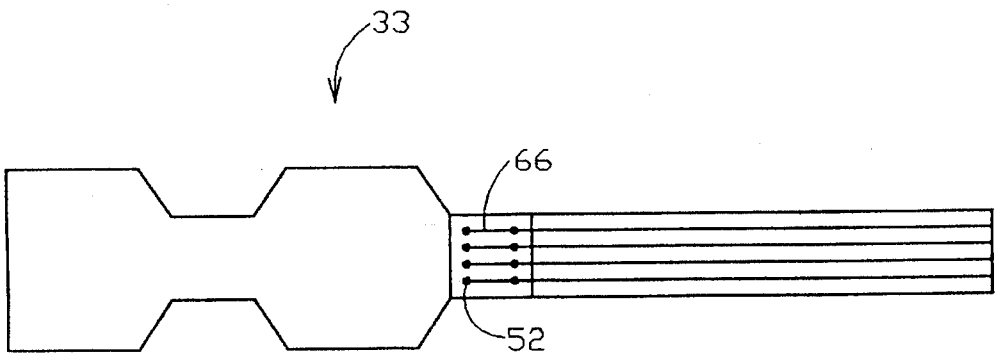
FIG. 4 shows a second embodiment of the security tag.

Referring now to FIG. 4, there is shown a second preferred embodiment of tag 33 wherein security element 32 is preceded by an elastic area 52 of the band through which the plurality of conductors pass. In this second preferred embodiment, the plurality of conductors pass through elastic area 52 of the band. Within elastic area 52, each of the plurality of conductors is constructed of a material which will easily bend but which will not stretch such as intertwined copper and fabric filaments 66. In the event the band is stretched in an attempt to remove it from the wrist or ankle of the infant, one or more copper and fabric filaments 66 will break causing a change in the number of completed circuits which are read by encoder circuit 20 and thus causing a corresponding change in the code which is transmitted by RF transmitter 21.

Figure 5:
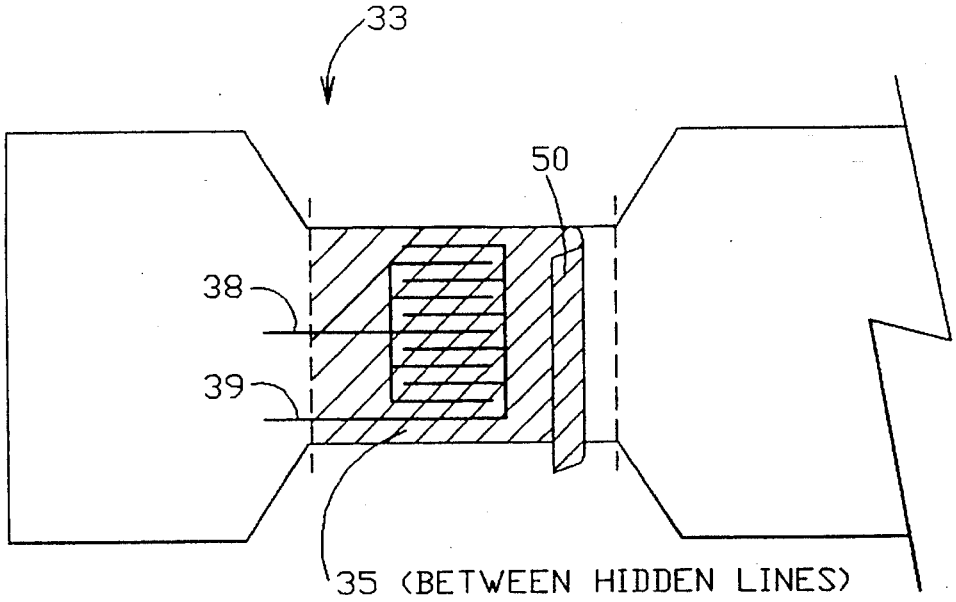
FIG. 5 shows a preferred embodiment of the power activation contacts on the security tag.
Figure 6:
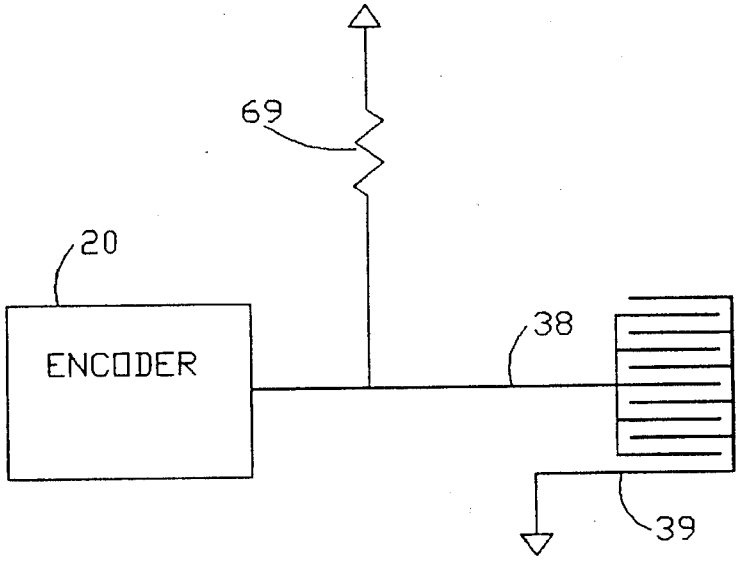
FIG. 6 shows a preferred embodiment of the power activation circuit on the security tag.

Referring now to FIGS. 5 and 6 there is shown power activation area 35 on tag 33 comprised of reset single conductor 38 and grounded single conductor 39 arranged in an interlocking matrix such that alternating parallel conductors of reset single conductor 38 and grounded single conductor 39 are immediately adjacent to one another. Reset single conductor 38 is operably connected to the reset function of encoder circuit 20. An internal direct current power means 22 is operably connected to encoder circuit 20 and to RF transmitter 21. Grounded single conductor 39 is connected to circuit ground. Subsequent to manufacturing of tag 33, a removable conductive covering 50 is applied to power activation area 35 such that reset single conductor 38 and grounded single conductor 39 are made to form a complete circuit thus causing tag 33 and all of its associated circuitry to remain in a quiescent state until such time as conductive covering 50 is removed during the course of activating tag 33. This function serves to conserve power during the time tag 33 is stored "on the shelf" and to increase the life of power means 22.

Figure 7:
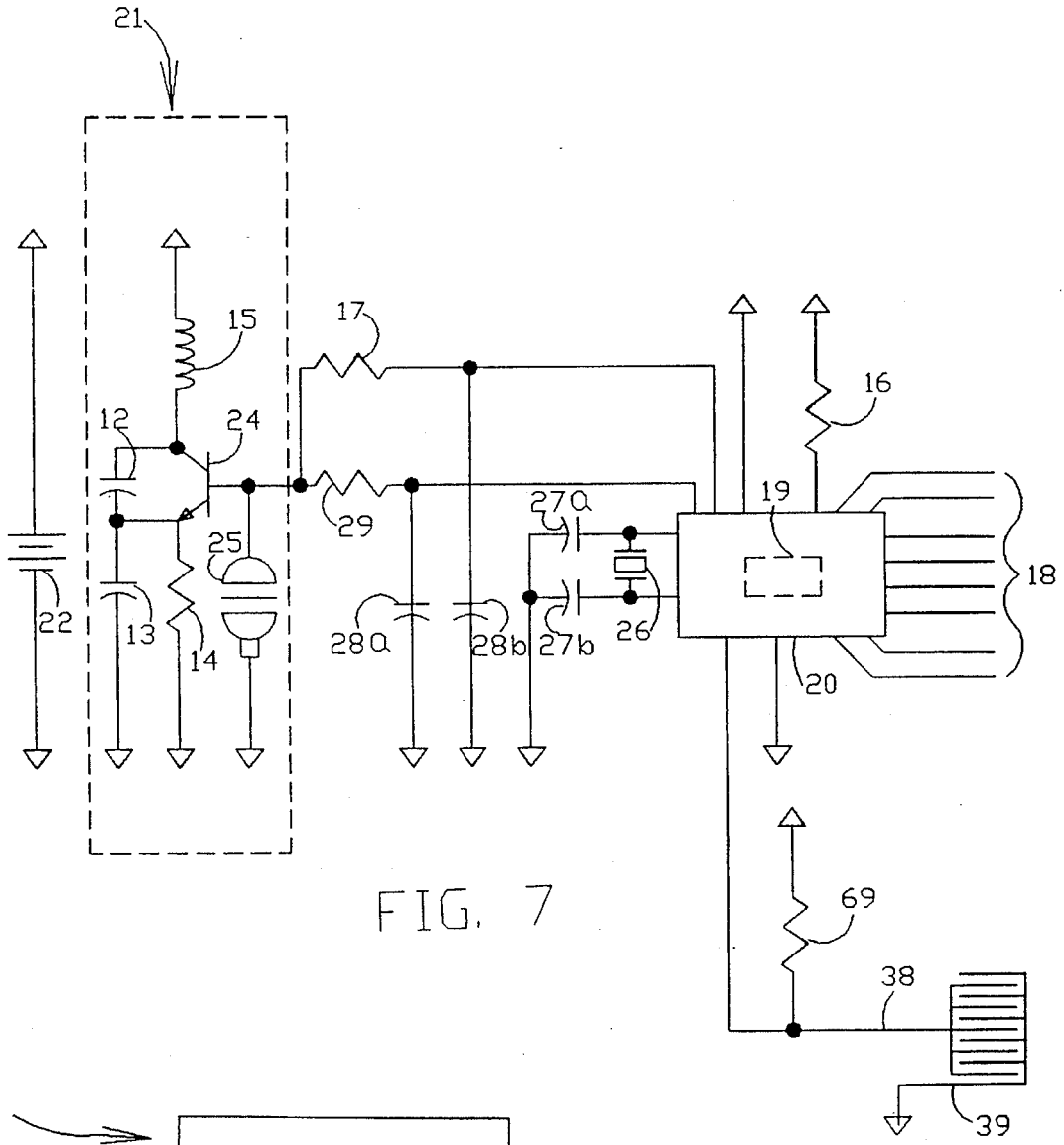
FIG. 7 shows a preferred embodiment of the electronic circuit comprising the security tag.

Referring now to FIG. 7, there is shown an electrical schematic of tag 33 comprised of encoder circuit 20, RF transmitter circuit 21 and power means 22. Attached to encoder circuit 20 is a crystal 26, crystal loading capacitors **27*a* and 27*b*, which together with certain components within encoder circuit 20 comprise a timing circuit which causes the functions of tag 33 to be performed on a periodic basis. Components within encoder circuit 20 perform various timing functions such as determining the interval between transmissions of the coded identity signal, determining the width of the individual bits of data being transmitted and changing these timings as required during operation. During periods of normal operation when there is no cause for an alarm condition, a plurality of bits comprising the identification code is serially output from encoder circuit 20 and sent through a primary current limiting resistor 29 to RF transistor 24. Bypass capacitor 28*a* prevents any radio frequency energy from interfering with the operation of encoder circuit 20 by shunting that energy to ground. RF transmitter 21 includes a frequency determining means 25, an RF transistor 24, a feedback capacitor 12, a current limiting resistor 14, a bypass capacitor 13 and a printed circuit stripline antenna 15. In operation, RF transistor 24 is biased off by limiting resistor 29 until a bit representing a binary one is to be transmitted. At that time, a positive direct current voltage of approximately 3 volts is applied to the base of RF transistor 24 by encoder circuit 20 through limiting resistor 29. Transistor 24 begins to conduct the positive voltage which is applied to its collector through limiting resistor 14. Feedback capacitor 12 operating in conjunction with frequency determining means 25 cause RF transistor 24 to enter into periods of conduction and non conduction at a frequency which , in the preferred embodiment, is approximately 418 megahertz. This oscillatory period continues for the duration of the one bit being transmitted and is terminated by encoder circuit 20 removing the positive voltage from limiting resistor 29. RF transmitter 21 is inactive during periods that bits representing binary zeros are transmitted. The signal thus produced by RF transmitter 21** is of the amplitude modulation variety with the degree of modulation being 100 percent.

Figure 8:
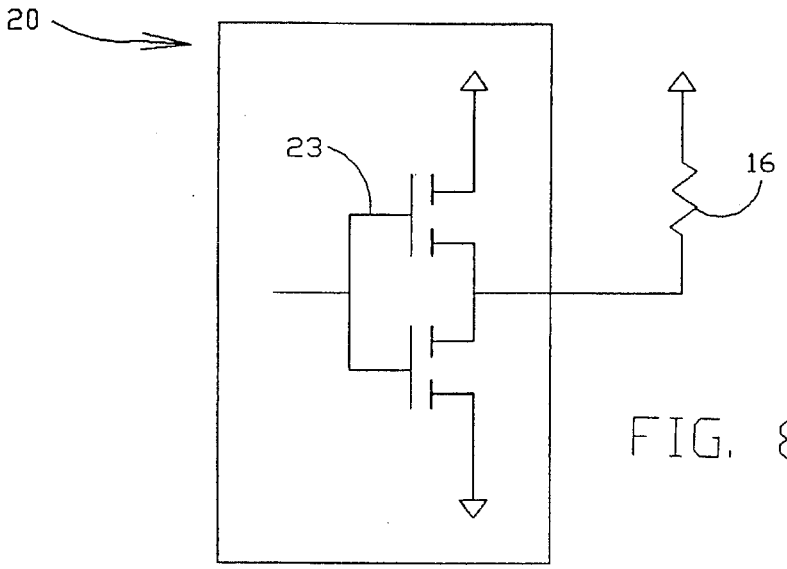
FIG. 8 shows a preferred embodiment of the electronic circuit for the power deactivation circuit of the security tag.

There is also shown in FIG. 7 an automatic deactivation circuit comprised of encoder circuit 20, a current absorbing resistor 16, a secondary current limiting resistor 17 and a bypass capacitor **28*b*. These circuit elements form a part of the automatic power deactivation circuit which serves to permanently turn tag 33 off within 2 to 4 hours of removal from the infant. Three things happen with regard to this power deactivation circuit once tag 33 has been removed from the infant for any reason and by any means. The first action is for the power deactivation elements of encoder circuit 20 to energize secondary current limiting resistor 17 and bypass capacitor 28*b* in addition to primary current limiting resistor 29 during the process of serially outputing data to RF transmitter 21. In this manner, the base of RF transistor 24 is driven further into conduction during periods of oscillation and thus made to consume more power from power means 22 through limiting resistor 14 causing the RF power output to increase by a factor of 5 while at the same time causing approximately twice the power from power means 22 to be consumed as would be the case when tag 33 is in its normal state; that is affixed to an infant. The second action is for encoder circuit 20 to decrease the interval between transmissions of coded identity data to approximately ⅕ that of the normal interval present when tag 33 is affixed to an infant. Third, referring to FIG. 8, encoder circuit 20 activates an internal field effect transistor 23 which applies a ground potential to one terminal of current absorbing resistor 16 . Since the other terminal of current absorbing resistor 16 is operably connected to power means 22, the completion of the circuit consisting of current absorbing resistor 16, internal transistor 23 and power means 22 will deplete power means 22 . The value of current absorbing resistor 16 is chosen to make the time period for deactivation approximately 2 to 4 hours. This time period allows for periodic short term removals of tag 33 by hospital staff as needed and yet insures that tag 33** will be deactivated shortly after the infant has been discharged from the hospital.

Figure 9:
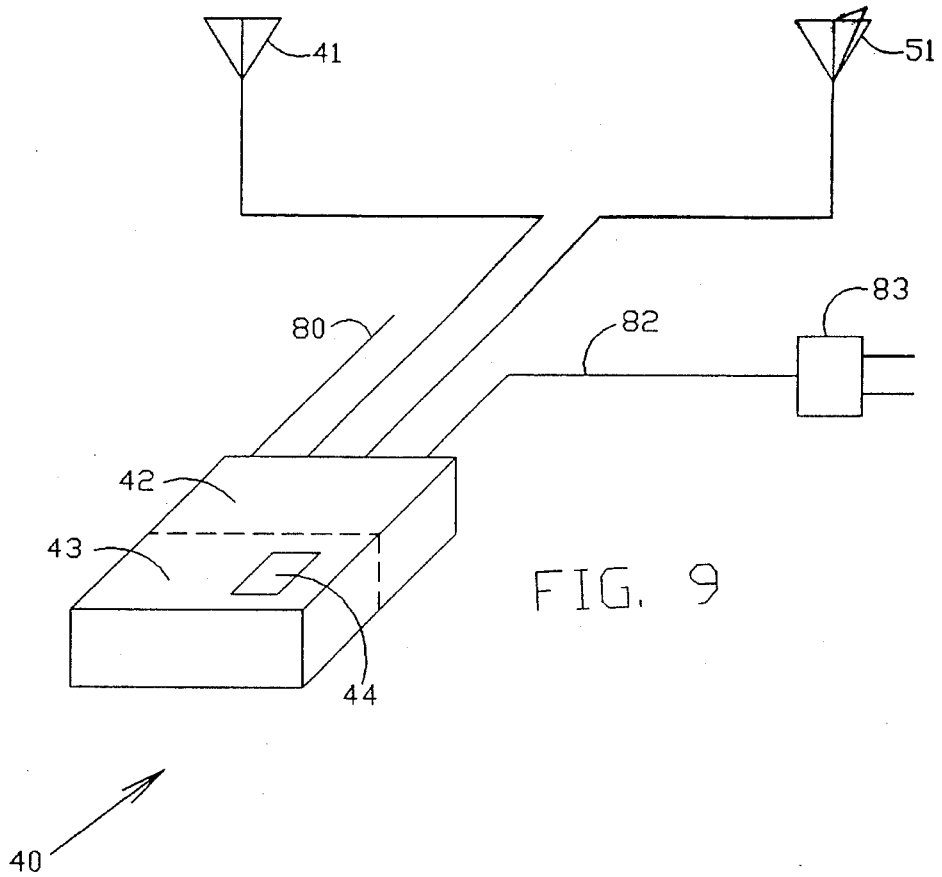
FIG. 9 shows the preferred embodiment of the receiver.

Referring now to FIG. 9 there is shown receiver module 40 to which is attached directional antenna 41 or omni directional antenna 51. Receiver 40 is comprised of an analog RF front end circuit 42 and a microprocessor decoding circuit 43. Signals picked up by omni directional antenna 51 or directional antenna 41 are amplified and processed by RF front end 42 of receiver 40 and then decoded by decoding circuit 43. As each signal is decoded by the decoding circuit 43 of receiver 40, it is compared to an internal memory list of previously received and decoded signals. If there is a match, no further action is taken. In the event there is no match, the newly decoded signal is added to the internal list and simultaneously transmitted to computer 60 over communications line 80. Algorithms within the internal memory of decoding circuit 43 insure that garbled transmissions such as would be caused by two or more tags 33 transmitting simultaneously are not passed along to computer 60 and are quickly removed from the internal list of valid decoded signals. Receiver 40 is powered by an external modular type power transformer 83 which is operably connected to receiver 40 by a low voltage power cable 82. Additional circuitry within receiver 40 continuously charges an internal rechargeable battery 44. Battery 44 powers receiver 40 during any periods of power outage.

Figure 10:
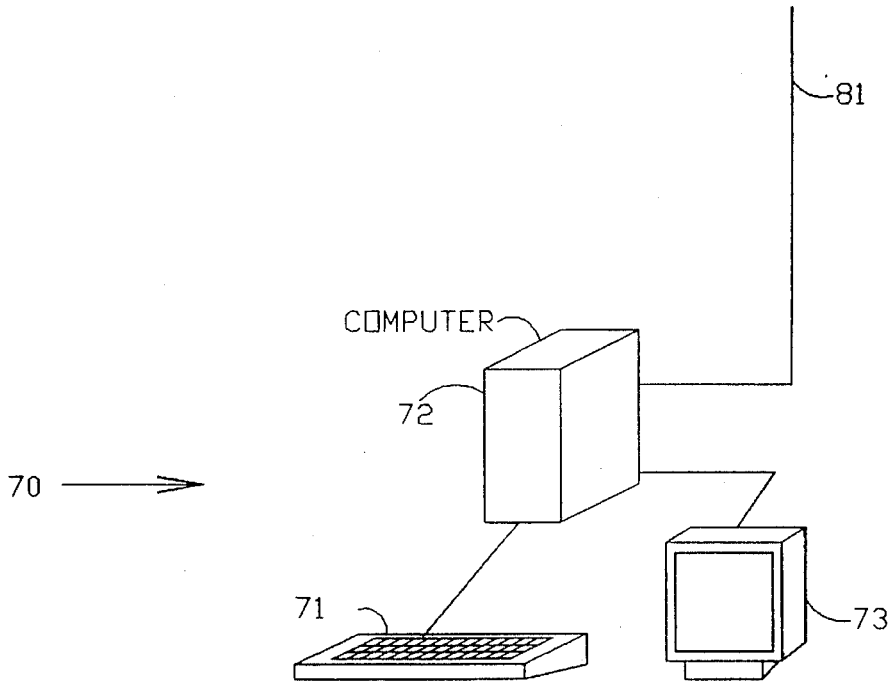
FIG. 10 shows the preferred embodiment of the remote security console.

Referring to FIG. 10 there is shown a preferred embodiment of remote security console 70 comprising a computer 72, a keyboard 71 and a CRT display 73 to which is operably connected communications line 81. In operation, computer 60 sends data representing the location and status of each infant currently being monitored to security console 70 over communications line 81. This data is displayed in real time on CRT display 73. Keyboard 71 is used only to initially start security console 70 when installed or to restart security console 70 in the event of some type of failure. Periodically, security console 70 is queried by computer 60 over communications line 81. A response is required to indicate the continued normal functioning of security console 70. Likewise, the data transmissions from computer 60 to security console 70 must be made on a periodic basis to indicate the continued normal functioning of computer 60. In the event of a failure of either computer 60 or security console 70, the remaining functional one of the pair will cause alarm 65 to be sounded.

Figure 11:
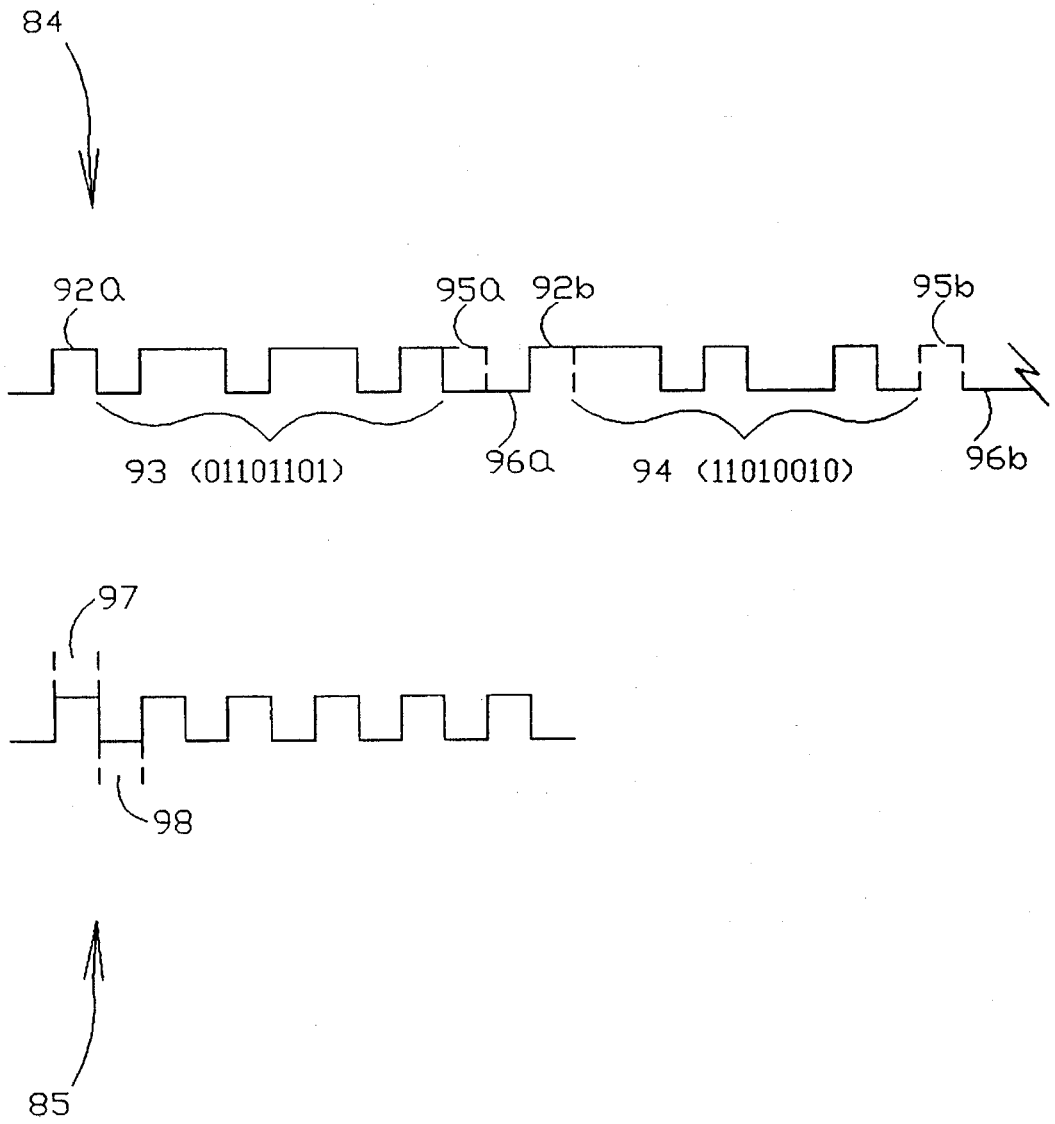
FIG. 11 shows a preferred embodiment of the timing for the RF signal which is transmitted by the security tag.

Referring finally to FIG. 11, there is shown a timing diagram which depicts a preferred embodiment of a coded identity data 84 comprising start bits 92*a* and start bits 92*b*, a first data byte 93 and a second data byte 94, an alarm bit 95*a* and an alarm bit 95*b* and stop bits 96*a* and stop bits 96*b*. During periods of transmission, encoder circuit 20 serially outputs start bit 92*a* followed by first data byte 93 followed by alarm bit 95*a* followed by stop bits 96*a* followed immediately by start bit 92*b* followed by second data byte 94 followed by alarm bit 95*b* followed by stop bits 96*b*. A timing line 85 depicts the width of a transmitted one bit 97 which is set to be approximately 488 microseconds and a transmitted zero bit 98 which is also set to be approximately 488 microseconds.

While the above description contains many specificities, these should not be construed as limitations to the scope of the invention, but rather as an exemplification of one or more of the preferred embodiments thereof. For example, the security tag could be used as a security device for elderly persons in nursing homes or to electronically track articles of differing sizes. The band portion of the security tag could be constructed of alternative materials in which a plurality of conductors had been embedded or imprinted. A mechanical fastener rather than an adhesive could be employed to keep the security tag attached to the person or article being monitored. Although the preferred embodiments of the digital encoding technique, RF transmission and powering of the security tag are taught by the present invention, it should be readily apparent to those skilled in the art that other digital encoding techniques, RF transmission means and powering of the security tag would applicable to the present invention as well and that it is the combination of elements of the present invention which make it novel and which together overcomes the deficiencies and problems of known prior art. The present invention is thus intended to encompass any number of modifications, variations and changes which might be made without departing from the scope of the present invention as defined herein in the appended claims.

It is to be understood also that the present invention is not limited to the illustrations described herein which are intended to be merely illustrative of the best modes of carrying out the invention and which are susceptible to modifications of form, size, arrangement of parts and details of operation. The invention is rather intended to encompass all such modifications which are in its spirit and scope as defined by the claims.

LIST OF REFERENCE NUMERALS

1–11 FIGS.
12 feedback capacitor
13 bypass capacitor
14 current limiting resistor
15 printed circuit antenna
16 current absorbing resistor
17 secondary current limiting resistor
18 plurality of conductive elements
19 non volatile memory
20 encoder circuit
21 RF transmitter
22 internal direct current power means
23 internal transistor
24 RF transistor
25 frequency determining means
26 crystal
27*a*, 27*b* crystal loading capacitors
28*a*, 28*b* bypass capacitors
29 primary current limiting resistor
30 infant security system
31 circuit area
32 conductive security element
33 security tag
34 adhesive area
35 power control circuit area
36 crosswise bridging contacts
37 adhesive area
38 reset single conductor
39 grounded single conductor
40 receiver
41 directional antenna
42 analog RF front end
43 microprocessor decoding circuit
44 internal rechargeable battery
50 removable conductive covering
51 omni directional antenna
52 elastic area
55*a*, 55*b* adhesive
60 central monitor computer
62 printer
65 local alarm
66 intertwined copper and fabric filaments
67 keyboard
68 CRT display
69 pullup resistor
70 remote security console
71 keyboard
72 computer
73 CRT display
80 first RS485 communications line
81 second RS485 communications line
82 low voltage power cable
83 power transformer
84 timing diagram
85 timing line
90 paging transmitter
91 paging receiver
92*a*, 92*b* start bits
93 first data byte
94 second data byte
95*a*, 95*b* alarm bits
96*a*, 96*b* stop bits
97 one bit
98 zero bit

What is claimed is:

1. An electronic security tag for uniquely identifying and locating persons or articles in order to prevent their removal from a protected area comprising:

a conductive security element attachment means having two ends, whose electrical state will change when stretched, severed, partially severed or removed by parting the ends;

an encoding means for generating a unique identity code for said tag;

an alarm code generating means for determining the electrical state of said attachment means and generating an alarm code indicating said state of said attachment means;

radiant energy transmission means for transmitting said identity code and said alarm code;

an internal direct current power means operably connected to said attachment means, said encoding means, said alarm code generating means and said radiant energy transmission means; and a power activation and deactivation means for activating said tag immediately prior to use and for permanently deactivating said tag subsequent to use.

2. An electronic security tag according to claim 1 wherein said attachment means comprises a band having two sides and two distinct ends; one end of said band being imprinted with a plurality of conductive circuits on one side of said band and operably connected to said encoding means and the other end of said band being imprinted on the opposite side with a plurality of crosswise bridging contacts, said conductive circuits and said bridging contacts together forming a plurality of completed circuits when the ends of said band are joined by superimposing the two imprinted areas of said band.

3. An electronic security tag according to claim 2 wherein said encoding means includes a memory, and periodically generates said unique identity code including a first code portion formed by an identity code which is imprinted within the memory of said encoding means during manufacture, and a second code portion which is determined by the relative position of said plurality of conductive circuits and said plurality of crosswise bridging contacts.

4. An electronic security tag according to claim 1 wherein said alarm code generating means is operably connected to each of said security element attachment means, said encoding means, said radiant energy transmission means and said power activation and deactivation means such that any attempt to remove said tag by stretching, severing, or partially severing said security element attachment means or by parting the ends of said security element attachment means when they are affixed to one another, will change said alarm code generated by said alarm code generating means and thus will change said alarm code transmitted by said radiant energy transmission means.

5. An electronic security tag according to claim 2 wherein said radiant energy transmission means includes a radio frequency transmitter circuit comprising a modulated carrier means and an antenna means which is imprinted upon said band and which which is operably connected to said encoding means and said power activation and deactivation means.

6. An electronic security tag according to claim 1 wherein said radiant energy transmission means includes an infra red transmitter circuit comprising a modulated carrier means and an infra red light emitting means each of which are operably connected to said encoding means and said power activation and deactivation means.

7. An electronic security tag according to claim 2 wherein said security element attachment means includes an elastic portion through which said plurality of conductive circuits on one side of said band pass wherein said conductive circuits are comprised of a non elastic material such that one or more of said conductive circuits will break in the event said elastic portion of said security element is stretched.

8. An electronic security tag having a power activation and deactivation means including a single reset conductor and a single grounded conductor imprinted upon a power activation circuit area of said tag and covered with a removable conductive covering such that said tag is caused to remain in an inactive state until said conductive covering is removed at which time said tag becomes fully active, in which the application or removal of said conductive covering to said power activation circuit area of said band changes the electrical state of said single reset conductor.

9. An electronic security tag according to claim 8 wherein said removable conductive covering includes an adhesive means which will cause said removable conductive covering to remain in contact with said power activation circuit area.

10. An electronic security tag according to claim 8 in which said tag includes a conductive security element and a plurality of crosswise bridging contacts, and wherein a portion of said removable conductive covering covers two adhesive areas of said security element which, when superimposed upon one another, cause said conductive security element and said plurality of crosswise bridging contacts to come into contact with one another.

11. An electronic security tag with two ends, comprising:

a security element attachment means whose electrical state changes if said two ends are parted;

an encoding and timing means for generating an identity code for said tag;

an internal direct current power means for providing power to operate said tag;

a radiant energy transmission means for periodically transmitting said identity code at a time interval; and a security tag self deactivation means including a plurality of conductors imprinted upon a front side of said tag, and a plurality of crosswise bridging contacts imprinted upon a back side of said tag, wherein a plurality of complete circuits are formed when the ends of said tag are superimposed upon one another, wherein said tag is deactivated by said self-deactivation means when the ends of said tag are parted or said security element attachment means is severed or stretched, causing said encoding and timing means to energize an increased energy consumption means which includes:

an RF power increasing means which increases the amount of energy radiated by said radiant energy transmission means;

a timing means which decreases the time interval between transmissions of said identity code from said radiant energy transmission means; and an energy absorbing means which absorbs energy from said internal direct current power means.

12. An electronic security tag according to claim 11 wherein said energy absorbing means includes a resistor means, one terminal of which is operably connected to said internal direct current power means, and the other terminal of which is operably connectable to a ground potential.

13. An electronic security tag with two ends, comprising:

a security element attachment means whose electrical state changes if said two ends are parted, including an elastic portion through which are passed a plurality of non-elastic conductors printed upon a front side of said tag, and a plurality of crosswise bridging contacts imprinted upon a back side of said tag in such a fashion as to cause a plurality of completed circuits to be formed when the ends of said tag are superimposed upon one another;

an encoding and timing means for generating an identity code for said tag;

an internal direct current power means for providing power to operate said tag;

a radiant energy transmission means for transmitting said identity code; and an energy absorbing means for draining said internal direct current power means when said tag is removed.

* * * * *